United States Patent [19]

Moscrip

[11] 4,413,474

[45] Nov. 8, 1983

[54] MECHANICAL ARRANGEMENTS FOR STIRLING-CYCLE, RECIPROCATING THERMAL MACHINES

[76] Inventor: William M. Moscrip, 309 Ellery Ct., Fredericksburg, Va. 22401

[21] Appl. No.: 406,729

[22] PCT Filed: May 14, 1982

[86] PCT No.: PCT/US82/00649

§ 371 Date: Jul. 29, 1982

§ 102(e) Date: Jul. 29, 1982

[87] PCT Pub. No.: WO82/04099

PCT Pub. Date: Nov. 25, 1982

[51] Int. Cl.[3] ..... F02G 1/04

[52] U.S. Cl. ..... 60/517

[58] Field of Search ..... 60/517, 525, 526

[56] References Cited

U.S. PATENT DOCUMENTS 3,385,051 5/1968 Kelly ..... 60/525

3,552,120 1/1971 Beale ..... 60/525

*Primary Examiner*—Allen M. Ostrager

*Attorney, Agent, or Firm*—W. Brown Morton, Jr.

[57] ABSTRACT

Mechanical arrangements with primary application to single-acting, multiple-piston, Stirling-cycle machines providing a dramatic reduction in mechanical complexity and production cost. Two specific new machines are disclosed in detail, a single-acting, two-piston "ducted axle" machine and a quasi double-acting, four piston "drum cam" machine. A power level control subsystem inherent in the ducted axle machine permits engine output to vary from maximum positive through zero to maximum negative under full load conditions by means of the simple rotation of a single moving part.

7 Claims, 14 Drawing Figures

(INVENTION)

MECHANICAL ARRANGEMENTS FOR STIRLING-CYCLE, RECIPROCATING THERMAL MACHINES

TECHNICAL FIELD

This invention relates to Stirling-cycle engines, also known as regenerative thermal machines, and more particularly to a set of new mechanical arrangements for the construction of a family of multiple-piston, Stirling-cycle machines. These machines embody a practical approximation to the well known Stirling thermodynamic cycle; employ unique design and arrangement of components and materials to achieve an ultimate mechanical simplicity; and perform with high efficiency in the production of both mechanical power (i.e., prime movers, compressors, fluid pumps) and refrigeration (i.e., refrigerators, air conditioners, heat pumps, gas liquefiers).

A Stirling-cycle engine is a machine which operates on a closed regenerative thermodynamic cycle, with periodic compression and expansion of a gaseous working fluid at different temperature levels, and where the flow is controlled by volume changes in such a way as to produce a net conversion of heat to work, or vice versa. The regenerator is a device which in prior art takes the form of a porous mass of metal in an insulated duct. This mass takes up heat from the working fluid during one part of the cycle, and subsequently returns it to the working fluid prior to the start of the next cycle. Thus the regenerator may be thought of as an oscillatory thermodynamic sponge, alternately absorbing and releasing heat with complete reversibility and no loss.

A reversible process for a thermodynamic system is an ideal process, which once having taken place, can be reversed without causing a change in either the system or its surroundings. Regenerative processes are reversible in that they involve reversible heat transfer and storage; their importance derives from the fact that idealized reversible heat transfer is closely approximated by the regenerators of actual machines. Thus the Stirling engine is the only practical example of a reversible heat engine which can be operated either as a prime mover or as a heat pump.

BACKGROUND

The Stirling-cycle engine was first conceived and reduced to practice in Scotland 164 years ago. A hot-air closed-cycle prime mover based on the principle was patented by the Reverend Robert Stirling in 1817 as an alternative to the explosively dangerous steam engine. Incredibly, this event occurred early in the Age of Steam, long before the invention of the internal combustion engine and several years before the first formal exposition of the laws of thermodynamics.

Air was the first and only working fluid in early 19th century machines, whereas hydrogen and helium have been the preferred working fluids for modern machines. In Great Britain, Europe, and the United States thousands of regenerative hot air prime movers in a variety of shapes and sizes were widely used throughout the 19th century. The smaller engines were reliable, reasonably efficient for their time, and most important, safe compared with contemporary reciprocating steam engines. The larger engines were less reliable, however, because they tended to overheat and often succumbed unexpectedly to premature material failure.

By 1920, therefore, the electric motor and the internal combustion engine had almost universally and completely replaced the hot air prime mover in the marketplace. Until recently there was little incentive or opportunity to reconsider the commercial exploitation of the Stirling engine's numerous potential advantages. This was partly because the state of the art in many areas of related technology was inadequate.

Since World War II, however, there have been unprecedented advances in the general technologies of machine design, heat transfer, materials science, system analysis and simulation, manufacturing methods, and Stirling engine development.

Today, in comparison to their conventional internal bustion counterparts, all modern Stirling prime movers are external combustion engines which consistently demonstrate, in the laboratory, higher efficiency, multifuel capability, lower exhaust emissions, quieter operation, equivalent power density, and superior torque characteristics. Nevertheless, none of these engines is mass produced for any commercial application anywhere in the modern world. The reason for this is that contemporary Stirling engines have been created largely by adapting traditional methods and designs from the more familiar internal combustion engine technology base, and are therefore complex.

Patchwork adaptation of the old as a shortcut path to the new is a process which inexorably produces a hodge-podge arrangement of excessive mechanical complexity and which inevitably results in high production costs. In the design of innovative high-technology devices, the easy or obvious solution to a design problem at the component level often leads to an unacceptably complex ramification at the system level. Despite clearly superior technical performance characteristics, therefore, contemporary Stirling engines are invariably not cost competitive from the standpoint of economical mass production.

DISCLOSURE OF INVENTION

The invention comprises fundamental concepts and mechanical components which are combined to form a new family of Stirling-cycle machines, specifically including the following: (1) a single-acting, two-piston engine having statationary, coaxial, in-line cylinders and employing a pair of cylindrical face cams affixed to the pistons to drive a centrally disposed flywheel element about a hollow shaft, herein termed a "ducted axle", which also serves as the regenerator housing; (2) an engine power level control subsystem associated with that ducted axle machine by which the instantaneous phase angle between the periodic reciprocating motions of the pistons is readily adjusted as a function of power demand; and (3) a quasi double-acting, multiple-piston engine having an annular and parallel array of cylinder and regenerator volumes and employing a single cylindrical drum cam to control the aforesaid instantaneous phase angle and to transfer mechanical work into or out of the machine.

The primary significance of the present invention is that it represents a radical departure from traditional mechanical arrangements and methods. It thereby achieves a striking reduction in overall complexity and cost, both at the system and at the component level. Indeed, in its simplest and perhaps most useful form, the ducted axle machine, the invention can be functionally accomplished with as few as five moving parts. Yet the same device can be scaled to virtually any size for application to products of enormous diversity, and it can be adapted to run on any fuel, whether gas, liquid, solid, or hybrid, or on any other heat source, including solar energy.

The invention constitutes a rare and special combination of superior technical performance, broad market potential, and economic mass producibility, and therefore portends a new era of more thermally efficient and cost effective power products. These include noiseless propane powered lawn mowers, thermal battery powered automobiles, biomass powered fishing vessels, solar powered irrigation pumps, and nuclear powered navy warships. And since the Stirling-cycle engine is thermodynamically reversible, the invention will find countless other applications in the realm of refrigerators, heat pumps, air conditioners, and the like.

It is a primary object of the invention to provide a new and improved family of Stirling-cycle machines which are mechanically uncomplicated and economical to produce on a large scale, and wherein the hot and cold regions of each machine are inherently located at extreme diametrically opposite ends.

It is another object of the invention to provide a single-acting, two-piston engine which possesses stationary, coaxial, in-line cylinders, and which employs a pair of cylindrical face cams affixed to the pistons to drive or be driven by a centrally disposed flywheel element about a hollow shaft or axle, said hollow shaft also being the regenerator duct of the machine, hence the name "ducted axle" machine.

It is a further object of the invention to provide an engine power level control subsystem in conjunction with the aforesaid ducted axle machine by means of which the instantaneous phase angle between the periodic motions of the expansion piston and the compression piston is readily adjusted as a direct function of power demand.

It is a still further object of the invention to provide a power and speed controlled ducted axle engine analogous to a synchronous electric motor-generator or converter to be used in a thermally conservative power plant involving regenerative braking and waste heat reclamation in conjunction with a thermal energy storage device (thermal accumulator) in order to accomplish certain specialized applications, chief among which is that of an automotive prime mover.

It is yet another object of the invention to provide a single-acting, quasi double-acting, multiple-piston engine series, each of which is comprised by an annular and parallel array of cylinders and regenerator volumes, and which employs a single cylindrical drum cam to control the phase relationships between each of the interconnected and periodically varying working volumes of a multiplicity of stages and to transfer mechanical work into or out of such machines, hence the name "drum cam" machines.

BRIEF DESCRIPTION OF DRAWINGS

Other objects, advantages, and novel features of the invention will become readily apparent upon consideration of the following detailed description when read in conjunction with the accompanying drawings wherein:

FIG. 2(*c*) is a pressure volume diagram which depicts the working of an actual machine;

BEST MODE FOR CARRYING OUT INVENTION

Figure 1:
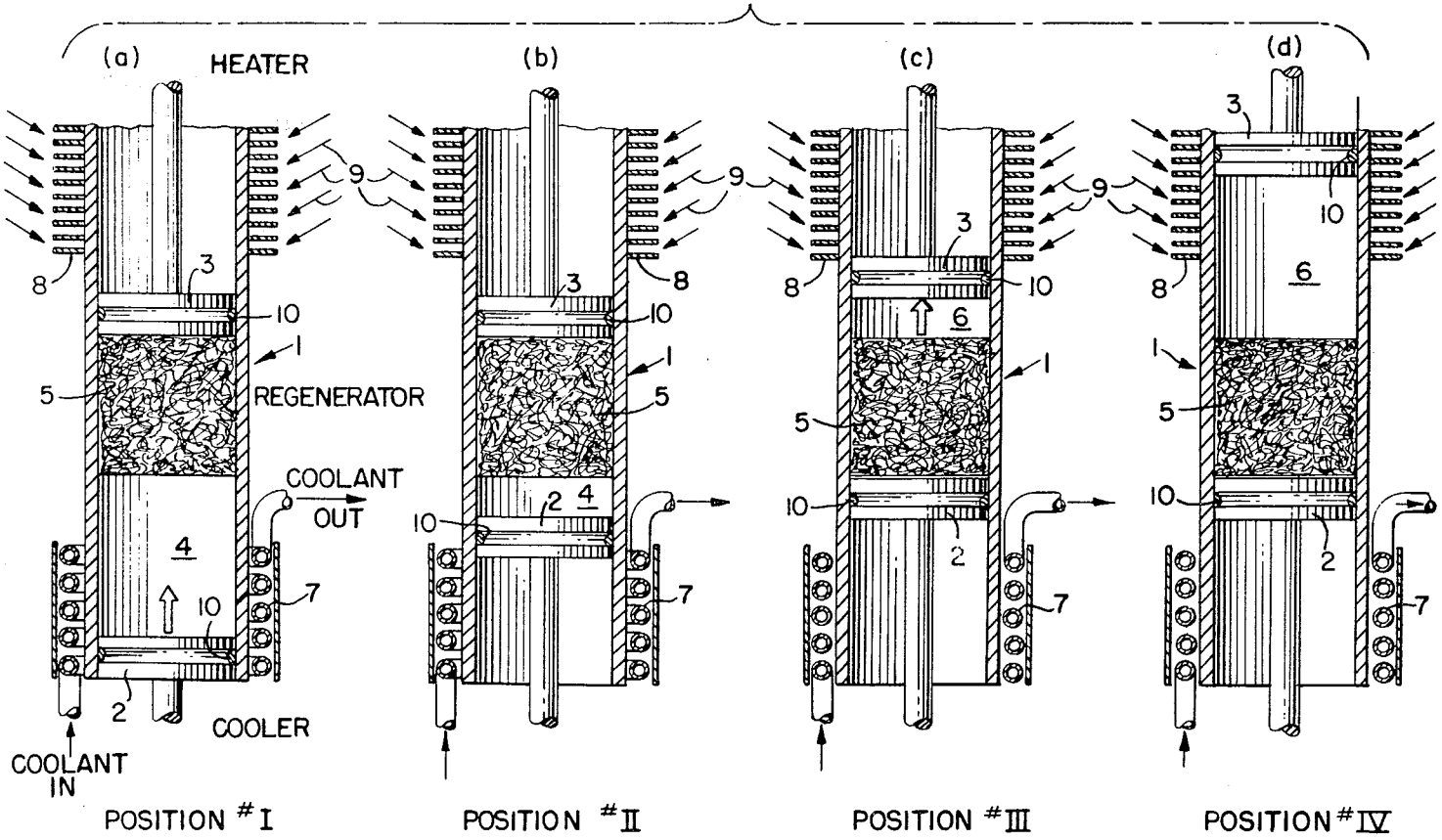
FIG. 1 is an illustration of the operational sequence of events during one complete cycle of an idealized single-acting, two-piston Stirling engine used in the prime mover mode.

Attention is directed to FIG. 1 wherein numeral 1 designates an idealized version of a two-piston, Stirling-cycle prime mover. A conceptually constant mass of pressurized gaseous working fluid occupies the working volume between the compression piston 2 and the expansion piston 3. The total working volume is comprised by compression space 4, regenerator 5, and expansion space 6.

A portion of compression space 4 is continually cooled by cooler 7, while a portion of expansion space 6 is continually heated by heater 8. Arrows 9 are intended to represent the input of heat by conduction, convection, or radiation. Escape of fluid from the working volume is prevented by the piston seals 10.

During the compression stroke (between positions I and II) the working fluid is compressed isothermally by piston 2 at the minimum temperature level of the cycle. Heat is continually rejected at this temperature through cooler 7; the pressure rises slightly and the total working volume decreases to a minimum. During the forward displacement (cold-side to hot-side transfer) stroke (between positions II and III) regenerator 5 yields stored heat to the working fluid as it is transferred to expansion space 6 with the volume remaining constant. The temperature and pressure rise to their maximum levels.

During the expansion stroke (between positions III and IV) the working fluid expands isothermally at a maximum temperature level of the cycle, doing work on piston 3. The temperature level is maintained by the input of heater 8; the pressure drops and the total working volume increases to a maximum. During the reverse displacement (hot-side to cold-side transfer) stroke (between positions IV and I) regenerator 5 recovers heat from the working fluid as it is transferred to compression space 4 with the volume remaining constant. The temperature and pressure return to the starting levels of the cycle.

Figure 2:
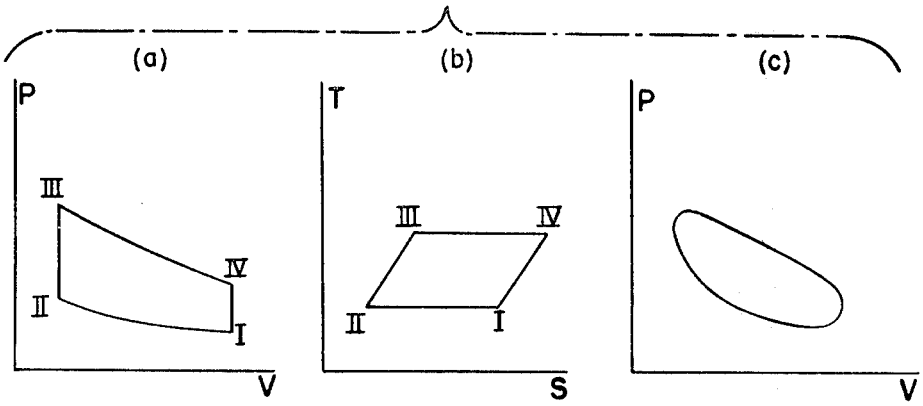
FIG. 2(*a*) and FIG. 2(*b*) are schematics which illustrate the idealized pressure-volume and temperature-entropy diagrams of the thermodynamic cycle of the working fluid in the same machine depicted by FIG. 1.

A clearer understanding of the foregoing may be obtained by referring to the diagrams of FIG. 2(*a*) and FIG. 2(*b*) wherein the same complete cycle is presented in terms of the pressure-volume diagram and the temperature-entropy diagram for the working fluid. For each process as depicted by the curves between the indicated position numbers I–II, II–III, III–IV, and IV–I, the area under a curve on the P-V diagram is a representative measure of the mechanical work added to or removed from the system during the process. Similarly, the area under a curve on a T-S diagram is a measure of the heat transferred to or rejected from the working fluid during the process.

Actual machines differ fundamentally from the idealized versions in that the motion of each piston is continuous and smooth, rather than discontinuous and abrupt. This causes the indicated processes of FIG. 2(*a*) and FIG. 2(*b*) to overlap one another, and results in P-V diagrams which are smooth continuous curves devoid of sharp corners as shown by FIG. 2(*c*). Thus the piston motion of actual machines is smoothly periodic to the point of being sinusoidal, and the working fluid is likewise distributed in a periodically time-variant manner throughout the total working volume. The instantaneous phase angle between the relative motions of the two pistons is a critical parameter in the operation of real machines and usually has a value on the order of 90 degrees. It is well-known, therefore, that various arrangements to accomplish phase angle adjustment may be used to effect continuous power level control. See e.g., U.S. Pat. No. 2,465,139 and No. 3,482,457.

The processes of compression and expansion in real machines are not strictly isothermal, which constitutes another major departure from the ideal. The provision of heater 8 adjacent to expansion space 6 and of cooler 7 adjacent to compression space 4 effects only a crude approximation to the isothermal condition. Additionally, the presence of these elements tends to increase the unswept or dead volume ratio, which has a critically adverse effect on performance. Moreover, the working fluid is heated or cooled, not only when flowing in the correct direction between regenerator 5 and either expansion space 6 or compression space 4, but also when flowing in the respective opposite directions. Nevertheless, extant Stirling engines exhibit comparable power densities and significantly greater efficiencies than conventional internal combustion engines of all types.

One favorable embodiment of the present invention may be characterized as a single-acting, two-piston engine with stationary, coaxial, in-line cylinders and a ducted axle. Although at first glance it would seem to have a similar arrangement to various classical opposed piston designs, close examination by those familiar with the art will reveal this new ducted axle design to be unique. The essential novelties and fundamental differences of the ducted axle machine, compared to those of all prior art multiple-piston engine designs, derive from the form, function, and mode of operation of the pistons themselves.

Figure 3:
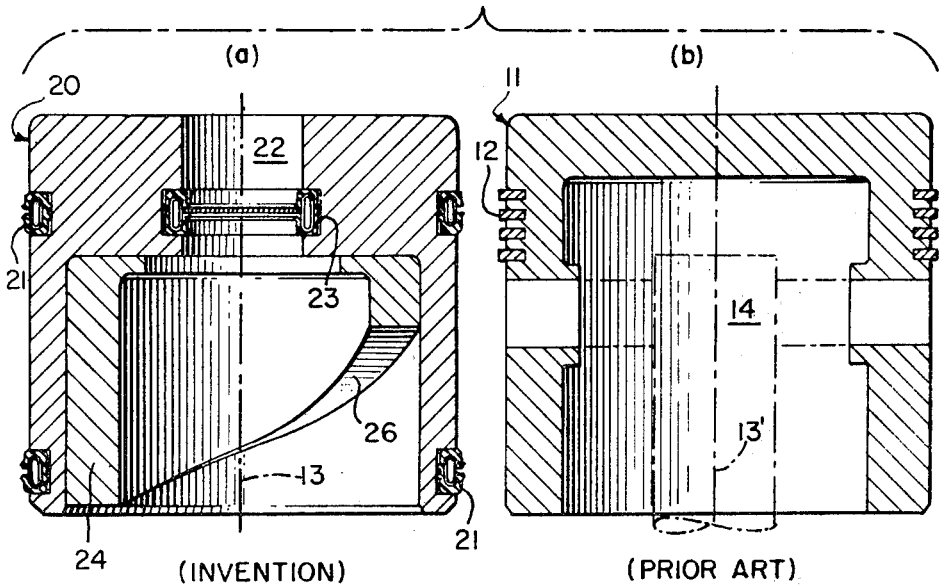
FIG. 3 shows a comparison of the basic features of a piston of the ducted axle machine according to my invention (FIG. 3(*a*)) with a piston of a representative prior art Stirling-cycle machine (FIG. 3(*b*))
Figure 4:
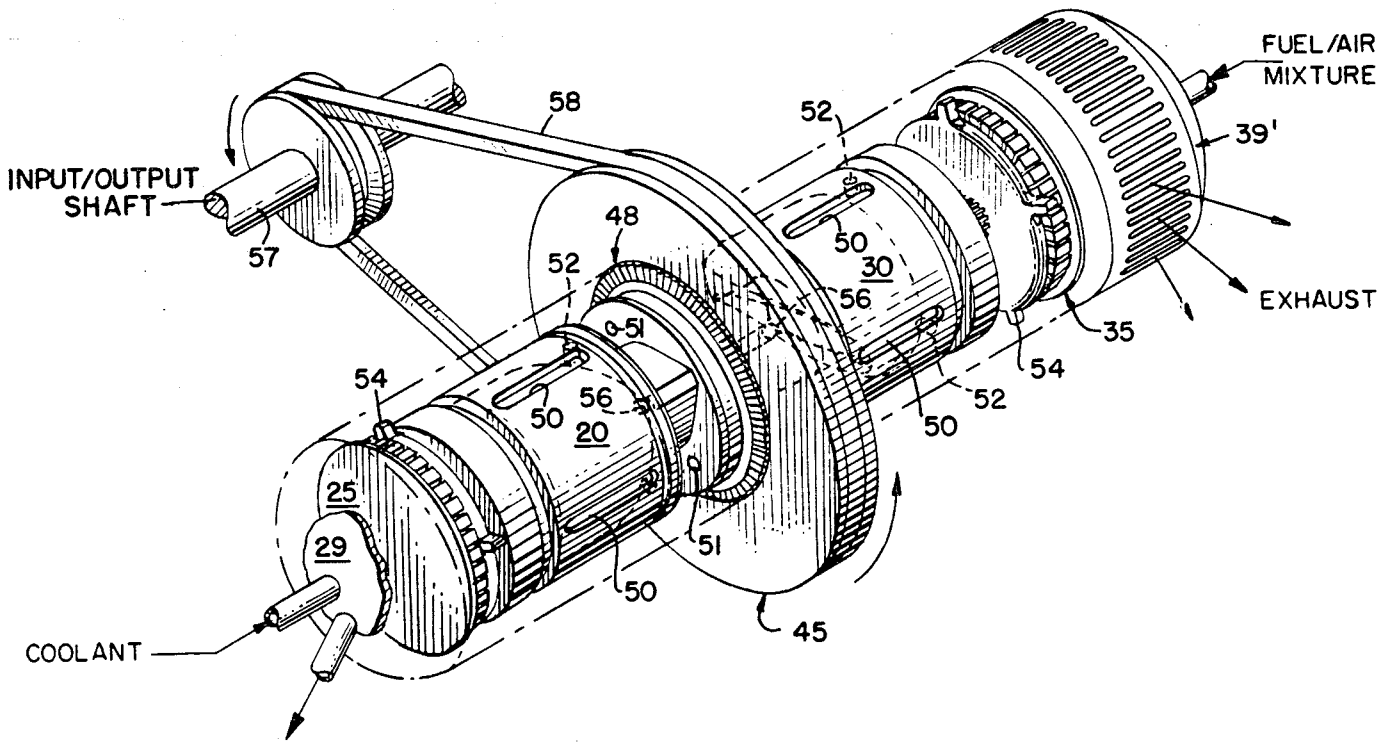
FIG. 4 is a perspective view which illustrates the overall functional configuration of the ducted axle machine.

Attention is now directed to the drawings of FIG. 3 wherein FIG. 3(*a*) shows the form of a piston 20 of a ducted axle machine as compared to that of a piston 11 from a prior art multiple-piston machine. It may be seen that piston 20 has no connecting rod 14 as does piston 11; that piston 20 incorporates a special cam surface 26 normal to that axis of reciprocation 13; and that there is an axial bore 22 through the top of piston 20. This last condition permits the pistons of a ducted axle machine to be operated in a coaxial arrangement surrounding, and at the opposite ends of, a tubular regenerator/shaft combination.

These and other details of the construction and operation of the ducted axle machine may be discerned by referring to the illustrations contained in FIG. 4, FIG. 5, FIG. 6, and FIG. 7. The regenerator/shaft or ducted axle 40 serves as the structural backbone of the machine and also provides an internally disposed conduit for the regenerator element 42. Ducted axle 40 is coaxial with the machine axis of symmetry 15, extends from one end of the machine to the other between cooler 25 and heater 35, and provides the axle about which the centrally disposed flywheel drive element 45 revolves. The rotational motion of the flywheel drive element is guided by a pair of radial bearings 46 and a pair of thrust bearings 48.

Figure 5:
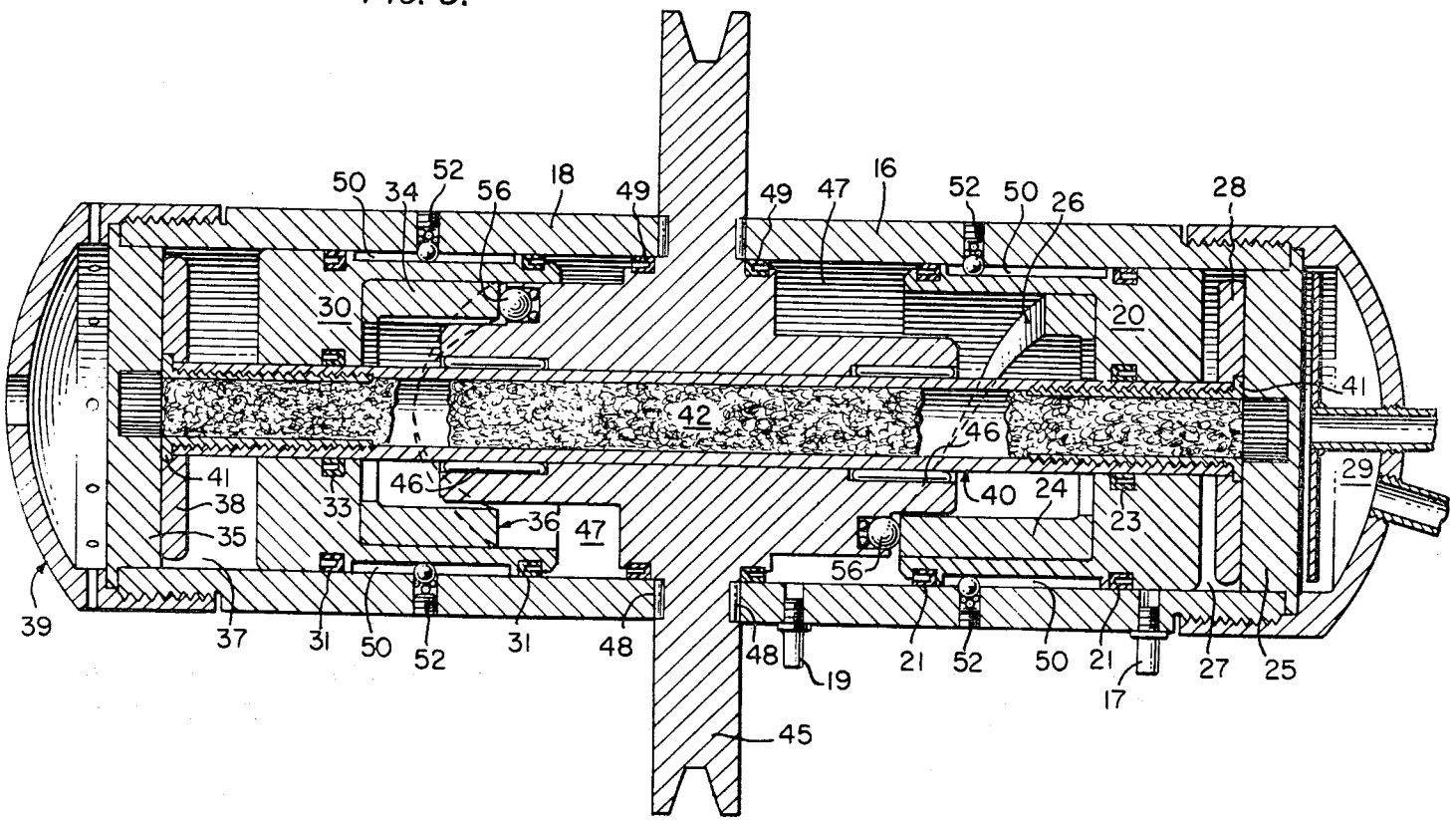
FIG. 5 is a sectional view of the ducted axle machine.
Figure 6:
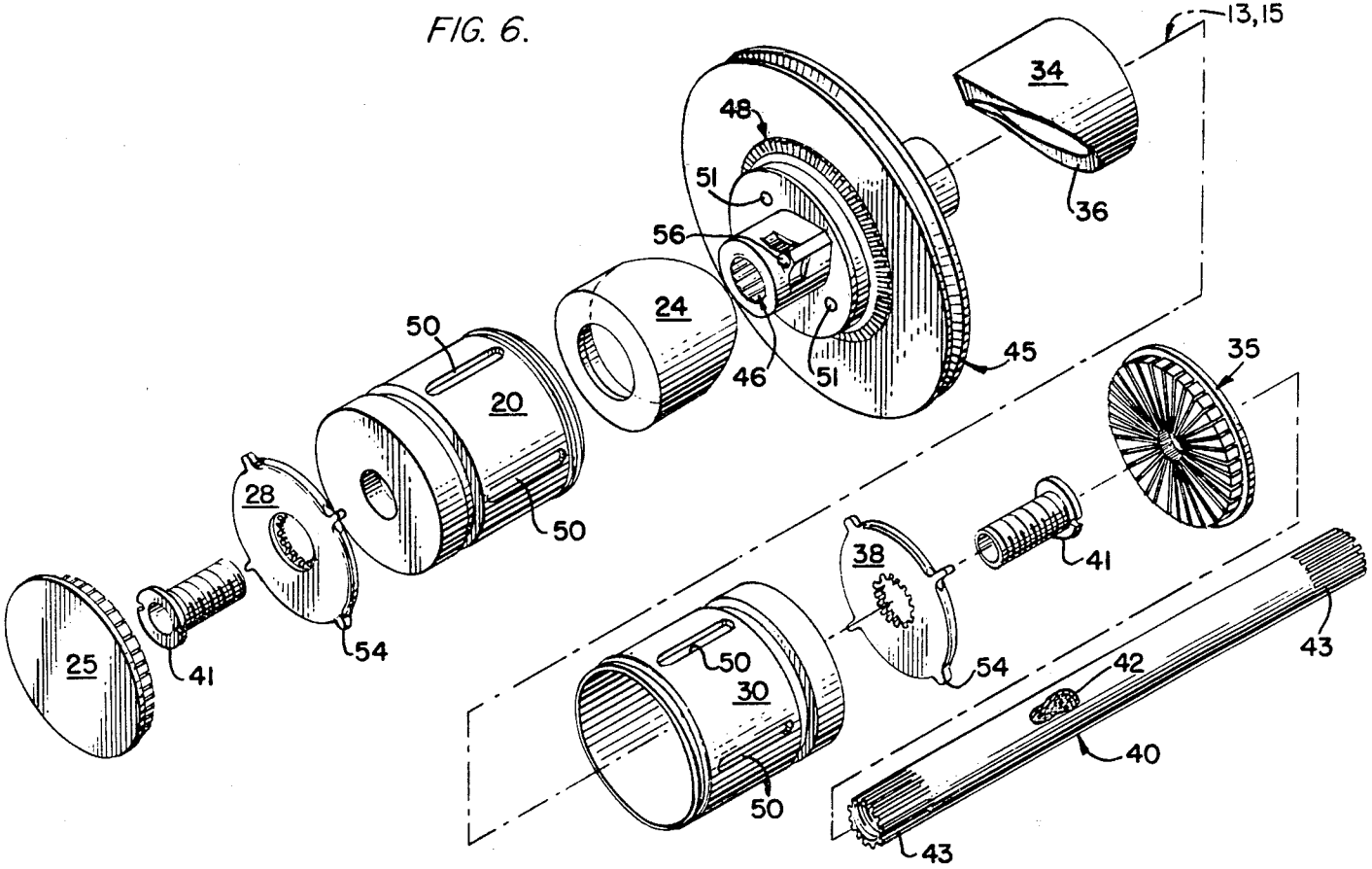
FIG. 6 is an exploded perspective view of the ducted axle machine.
Figure 7:
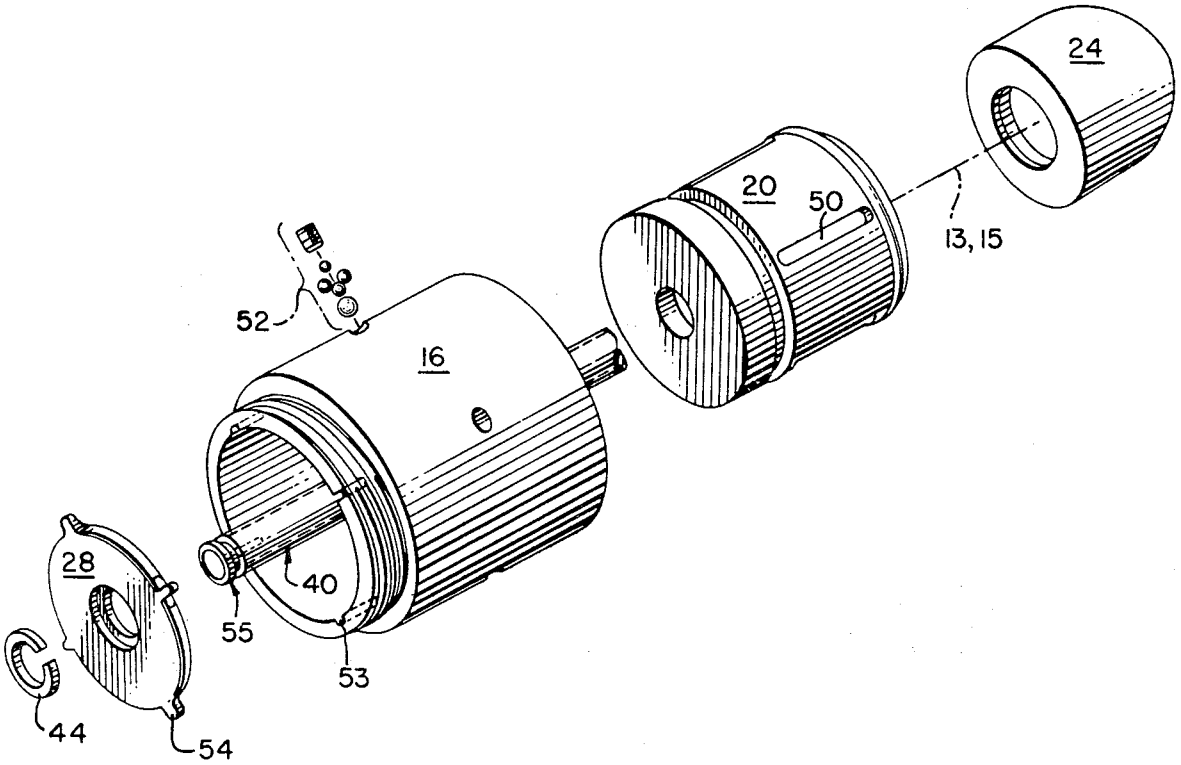
FIG. 7 is a partial exploded perspective view of the compression piston and cylinder assembly which illustrates one arrangement for achieving rotation of that assembly about the ducted axle axis relative to the expansion piston and cylinder assembly.

As shown in the sectional view, FIG. 5, a pair of stationary, coaxial, in-line, right-circular cylinders comprises the housing of the ducted axle machine. Compression cylinder 16 encloses compression space 27 and all other compression elements, is closed and sealed at one end by cooler 25, and is threaded to receive cooler head 29. Expansion cylinder 18 encloses expansion space 37 and all other expansion elements, is closed and sealed at one end by heater 35, and is threaded to receive heater head 39. As exemplified in FIG. 4, heater head 39 may take on a variety of forms to accommodate various combustors, collectors, thermal accumulators, or other sources of heat. Both cylinders (shown in FIG. 5) are equipped with a plurality of radial and annular slots 53 disposed within their interior wall which are designed to mate (as shown in FIG. 7 for the compression piston and cylinder assembly) with corresponding tabs 54 on both the compression disk element 28 and the expansion disk element 38.

The disk elements are designed to be affixed to the extreme opposite ends of the ducted axle 40 and together with it comprise the interior frame or structural support of the machine. Various mechanical fastener means may be used, depending upon whether it is desired to prohibit or permit relative rotation of either disk about ducted axle 40. In the first case a threaded retainer 41 and a spline 43 are provided; in the second case the retainer 44 is a heavy duty snap ring mated to groove 55. In either case the disk elements serve to constrain the longitudinal placement of both cylinders in relation to ducted axle 40 and to direct the flow of working fluid to and from the periphery of cooler 25 and heater 35.

It may be seen that compression piston 20 incorporates internally a coaxially disposed cylindrical face cam 24 having a cam surface 26 which is oriented in such a way as to face, and to maintain a particular angular position with respect to, the corresponding cam surface 36 of cylindrical face cam 34 similarly fixed within expansion piston 30. The pressure forces of the working fluid hold each cam against low-friction cam follower assemblies 56 mounted upon flywheel drive element 45. The reciprocating motion of the pistons within the cylinders and along the ducted axle is coupled to and converted into or from rotational motion of flywheel drive element 45, and vice versa, by opposed cam surfaces 26 and 36. Angular rotation of the pistons within the bore is prevented without restricting their axial reciprocation by means of longitudinal slots 50 which are engaged by piston guide assemblies 52.

Reciprocating seals 21 and 23 prevent the escape of working fluid from compression space 27, while reciprocating seals 31 and 33 similarly contain the working fluid within expansion space 37. Rotating seals 49 contain a separate quantity of gaseous buffer fluid within buffer space 47, which is partially pressurized to reduce the magnitude of the static loading on the cams. Holes 51 within flywheel drive element 45 conjoin the compression and expansion sections of buffer space 47. During the aforementioned forward and reverse displacement strokes, therefore, working fluid is alternately shifted from compression space 27, over the rounded periphery of compression disk element 28, through the radial flow passages of cooler 25, through regenerator element 42 within ducted axle 40, through the radial flow passages of heater 35, over the rounded periphery of expansion disk element 38, to expansion space 37, and back again. Working fluid is introduced into the working volume by means of tank valve 17; buffer fluid is introduced into the buffer space by means of tank valve 19.

One revolution of flywheel drive element 45 corresponds to one complete thermodynamic cycle. When the machine is employed as a prime mover, work is done on flywheel drive element 45 to increase its kinetic energy during the aforementioned expansion stroke of each cycle; likewise, work is done on the working fluid by flywheel drive element 45 during the compression and displacement phases of each cycle. Net power output may be transferred from flywheel drive element 45 to the indicated output shaft 57 by means of any common mechanical transmission such as a V-belt (designated by numeral 58 in FIG. 4), chain or gear drive assembly. Since the Stirling prime mover is not self-starting, an external starter device (not shown) would normally be an adjunct to the power transmission subsystem.

When the machine is to be employed as a refrigerator or a heat pump, power from an external source such as an electric motor would be input through shaft 57 and transmitted to flywheel drive element 45 by similar means. It would, of course, be necessary in this case to alter the configuration of cooler head 29 and heater head 39 to conform to the specific heat transfer requirements of any given practical application. But when driven in this manner, the complete thermodynamic reversibility of the ducted axle machine would produce the desired effects within the heat exchange elements at each end of the machine. That is, given the same mechanical configuration and orientation, heat would be extracted from the surrounds of heater 35 within expansion cylinder 18 and would be ejected to the surrounds of cooler 25 within compression cylinder 16, since the flow of heat generally progresses in one direction in a regenerative thermal machine.

A significant consequence of the ducted axle machine arrangement is to permit, in one embodiment of the invention, a uniquely uncomplicated power level control method. It should be recalled at this point that the instantaneous phase angle between the sinusoidally time-variant reciprocations of the pistons in a Striling engine is a critical performance parameter. It will be readily appreciated by those skilled in the art that the instantaneous phase angle of the ducted axle machine depends only upon the relative angular displacement of compression cam 24 with respect to that of expansion cam 34 for a given rotational direction of flywheel drive element 45. As shown in FIG. 7, the angular alignment of compression cylinder 16 with respect to that of expansion cylinder 18, and therefore the angular position of compression cam 24 with respect to that of expansion cam 34 (since the pistons are slaved in rotation to the cylinders by guide assemblies 52), can be facilitated by design.

Figure 8:
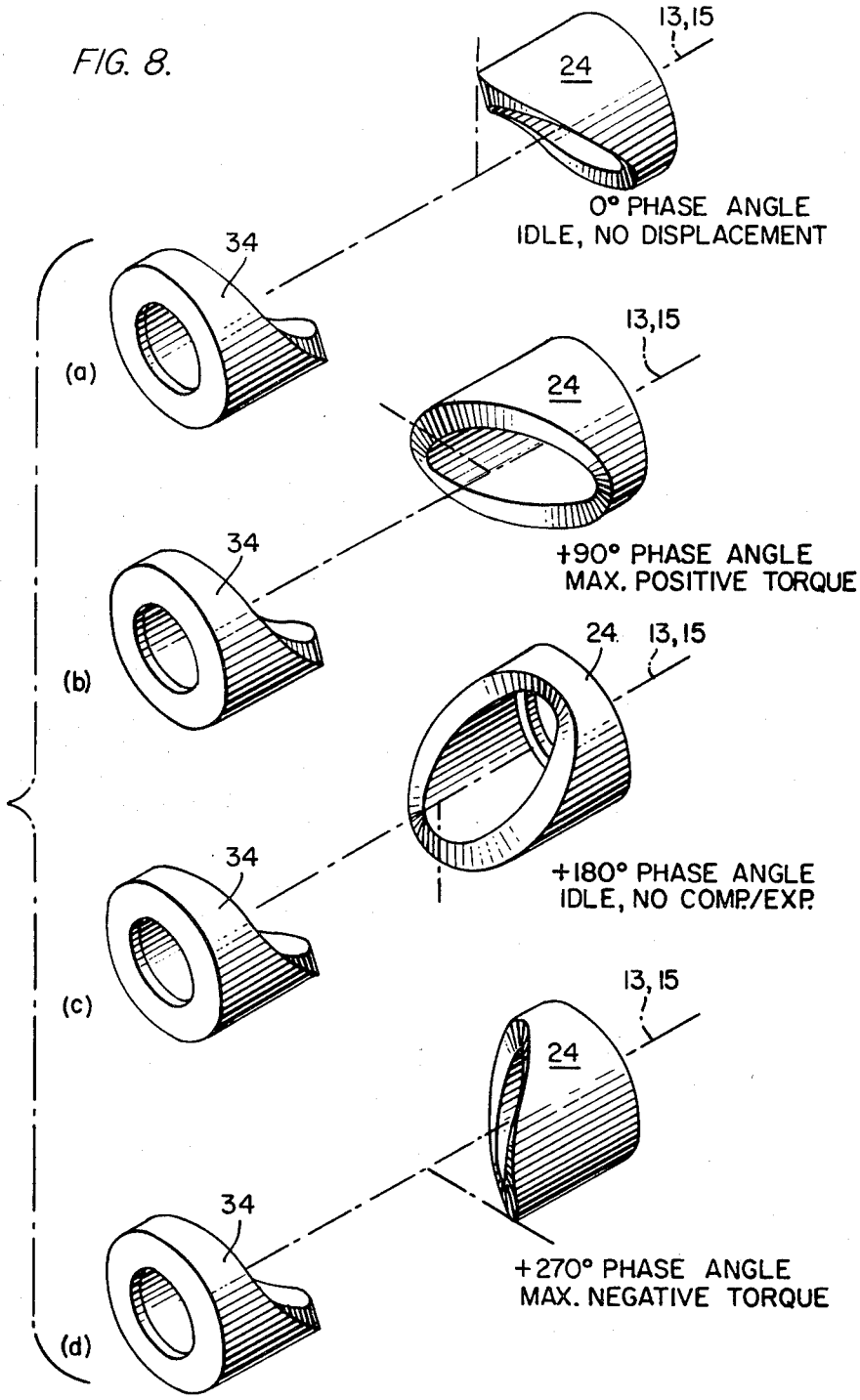
FIG. 8 illustrates how said rotation alters the relative orientation of the cylindrical face cams on the piston to achieve various output torque levels by adjusting the instantaneous piston phase angle.

Thus, it is an important teaching of this invention that it is possible to alter the operation of the ducted axle machine from positive torque, through zero torque, to negative torque by mechanical means, even while the machine is running under a maximum load condition, by simply rotating one cylinder with respect to the other. This is illustrated schematically in FIG. 8; the desired angular adjustment may be accomplished virtually independent of the load by electric, pneumatic, hydraulic, or any other suitable mechanical means.

In this manner the instantaneous phase angle, and consequently the power level of the machine, may be either manually or automatically controlled with precision by an enormous variety of mechanical, thermal, electronic, or other conventional and well-known feedback methods. With this type of power level control one can thereby optimize engine performance and efficiency for any given speed and torque requirements inherent in the nature of the system application. This is a natural and synergistic consequence of the deceptively simple employment of cylindrical face cams in the manner indicated, an essential and distinctive aspect of the seemingly artless character of the ducted axle machine.

Moreover, yet another important specific teaching of this invention is that speed controlled engines analogous to a synchronous electric motor-generator or converter may be developed on this basis for specialized applications. That is, the engine would act either as a prime mover or as a heat pump depending on whether the engine is driving the load or the load is driving the engine at a selected excitation frequency. This type of device could have a striking impact on the technology of transportation from the standpoint of total system energy efficiency and conservation. The effective utilization of the aforesaid negative torque mode for regenerative braking and reversible heat reclamation in the largely stop-and-go environment of the automotive prime mover may consititute a technological breakthrough of astounding economic significance.

Another favorable embodiment of the invention may be characterized as a single-acting, quasi-double acting, four-piston engine having an annular and parallel array of cylinders and regenerators interconnected in series and incorporating a cylindrical drum cam drive element. That is, the machine has four in-line cylinder pairs arranged within and symmetrically about a cylindrical annulus which also contains four regenerator ducts exterior from, parallel to, and alternately interspersed among the cylinders. These are all interconnected in a series so as to form a folded serpertine arrangement in conjunction with four double-ended pistons within the aforesaid cylindrical annulus. The drive shaft is coaxial with and integral to a right-circular cylindrical drum cam mechanism which is interior to and symmetrical with the said annular array of components.

Figure 9:
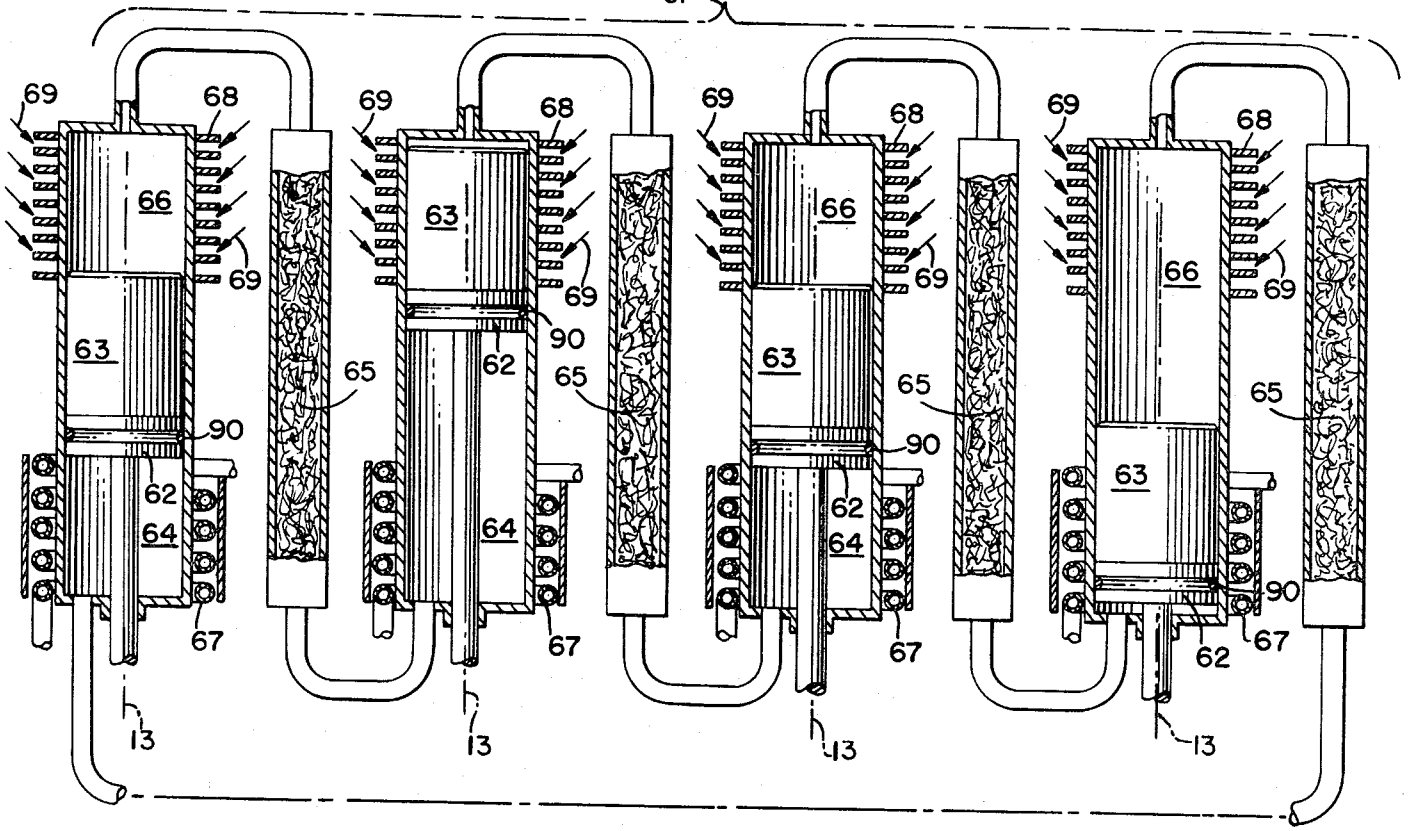
FIG. 9. (PRIOR ART)
FIG. 9 is a schematic representation of the prior art Rinia double-acting, multiple-piston mechanical arrangement.

Although the present machine is strictly a single-acting, multiple-piston engine, it retains a superficial resemblance to certain well-known contemporary double-acting Stirling engines, hence the term quasi double-acting. Attention is now directed to the drawings of FIG. 9 wherein numeral 61 designates a schematized version of the modern double-acting Stirling engine of the type due to Rinia and described by prior art U.S. Pat. No. 2,579,702. As is appreciated by those familiar with the art, this machine is double-acting because each piston 62 simultaneously works directly against the low temperature working fluid in compression space 64 below, and against the high temperature working fluid in expansion space 66 above, seal 90. It may be seen that in the Rinia arrangement multiple cylinders are interconnected, so that the first swept volume of lower compression space 64 of one cylinder is connected to the last swept volume of the upper expansion space 66 of an adjacent cylinder by means of a flow path comprising the last swept volume of space 64 jacketed by cooler 67, a regenerator 65, and the first swept volume of space 66 jacketed by heater 68 in series. The jacketed portion of compression space 64 is continually cooled by cooler 67 and the jacketed portion of expansion space 66 is continually heated by heater 68; arrows 69 are intended to represent the input of heat by conduction, convection, and radiation.

Each separate working volume so interconnected constitutes a stage wherein both the constant volume displacement functions and the compression and expansion functions of the Stirling cycle are independently accomplished as long as pistons 62 are constrained by the design of the drive mechanism (not shown) to move with a suitable phase shift in their displacement. In the case of four-cylinder Rinia type engines as illustrated, the proper phase shift is 90 degrees which is normally accomplished by means of well-known swash plate or crankshaft type drive mechanisms. The Rinia arrangement has the advantage that the number of moving parts associated with a given cylinder is only one per cycle, compared with two per cycle in other prior art designs. It also affords a reasonably compact mechanical arrangement when the cylinders are arranged parallel to one another in a cylindrical annulus and the pistons are coordinated by means of a swash plate mechanism internal to the annular volume.

Inherent in the design of the Rinia engine, however, is the requirement for each piston 62 to operate in the aforesaid double-acting mode. This is disadvantageous in that both the piston and the cylinder wall constitute an undesirably short thermal conduction path from the normally hot to the normally cold regions of the machine. Since any heat flow between these regions represents a total thermal loss to the system and lowers the overall thermal efficiency, this circumstance necessitates in prior art machines the utilization of a long insulating piston cap 63 or other device as more fully explained by prior art U.S. Pat. No. 3,496,720 and exacerbates an already difficult high pressure reciprocating seal design problem. In addition, the mechanical necessity of extending piston rod through the wall of compression space 64 along axis of reciprocation 13 requires the placement of the drive mechanism, whether of the swash plate or crankshaft type, at the opposite end of the machine from heaters 68. This in turn relegates the locus of coolers 67 to a position which is undesirably proximate to heaters 68, and which precludes their natural collocation in an uncomplicated manner.

Figure 10:
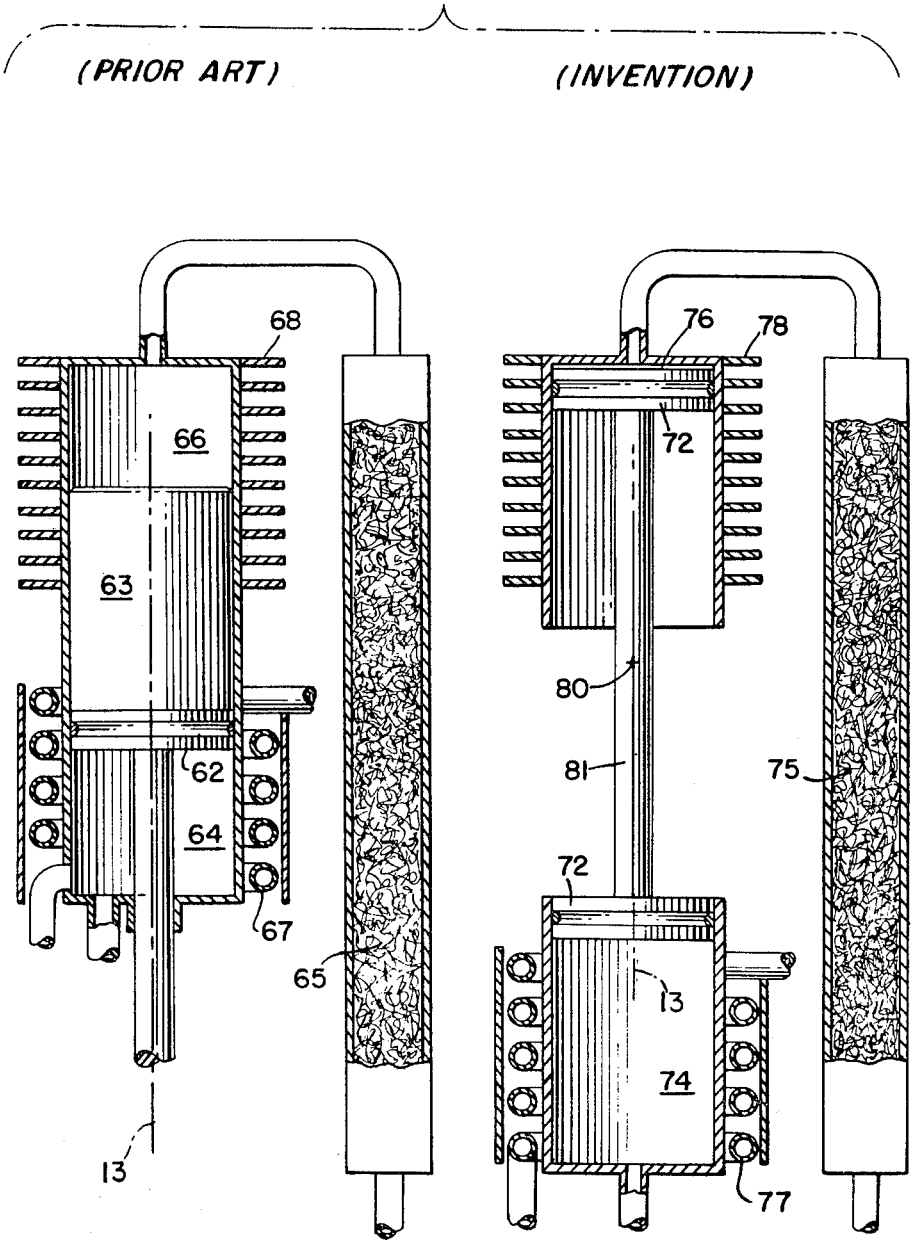
FIG. 10 is a schematic illustration of how one compression/expansion/regeneration state of a single-acting, quasi double-acting arrangement according to my invention may be derived from a simple conceptual transformation of such a stage of the Rinia double-acting arrangement.

Attention is now directed to the drawings of FIG. 10, FIG. 11, FIG. 12, FIG. 13, and FIG. 14 wherein a preferred embodiment of the drum cam machine of the present invention is illustrated. It may be understood that the drum cam machine represents a fundamental departure from the Rinia arrangement in that the number of cylinders is doubled, and the pistons are incorporated in rigid-body pairs at the opposite ends of double-ended connecting rods in the manner of a dumbbell. As depicted in FIG. 10 the desired configuration can be imagined to derive from a simple conceptual transformation of the Rinia arrangement which preserves the manner in which the cylinders, now become disjoint cylinder pairs, are interconnected, but which replaces the double-acting character of the Rinia approach with a single-acting, quasi double-acting mode. It may be seen that the new arrangement disposes of the undesirable aspects of the Rinia arrangement without disturbing the cylic phase relationship inherent in equivalent working volumes.

Figure 11:
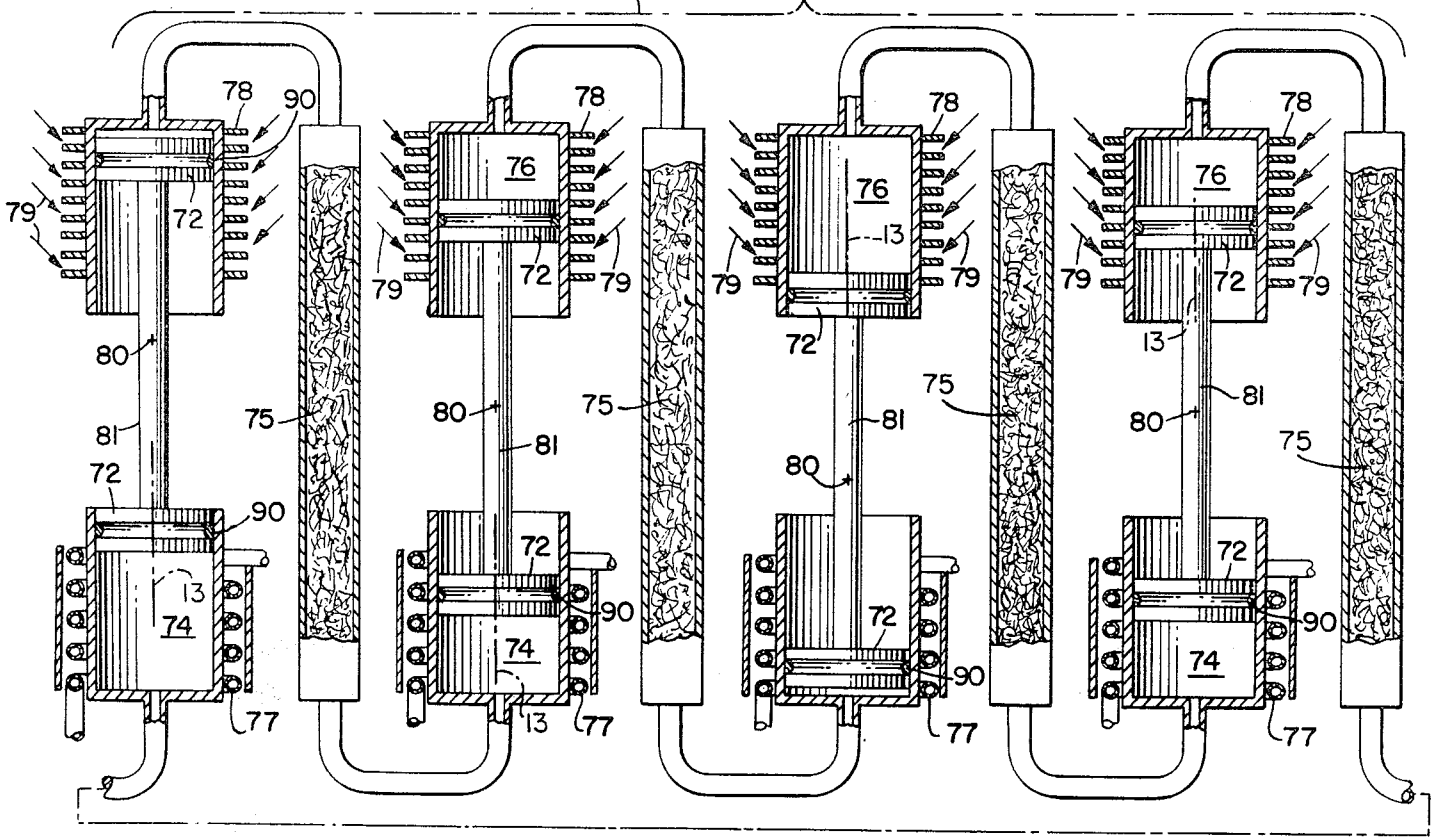
FIG. 11 is a schematic representation of a multi-stage, single-acting, quasi double-acting mechanical arrangement according to my invention.

Referring now to FIG. 11, it may be recognized that numeral 71 designates a schematized version of the quasi double-acting drum cam machine of the present invention. Those skilled in the art will appreciate that this machine is single-acting because only one surface of each piston 72 works directly against working fluid pressure, whether at low temperature in compression space 74 below or at high temperature in expansion space 76 above the seals 90, the other surface being substantially at atmospheric. Yet, as in the Rinia arrangement, multiple cylinders are fluid flow interconnected, so that the lower compression space 74 of one cylinder is connected to the upper expansion space 76 of an adjacent cylinder by means of a flow path past cooler 77, through regenerator 75, and past heater 78 in series. And, as before, a portion of compression space 74 is continually cooled by cooler 77, while a portion of expansion space 76 is continually heated by heater 78; arrows 79 are intended to represent the input of heat by conduction, convection, or radiation.

In the arrangement of my invention, however, the thermal conduction path through pistons 72 from each hot expansion space 76 to each cold compression space 74 is now seen to be considerably lengthened, notwithstanding the complete elimination of the use of an insulative piston cap 63. Neither is there any thermal loss occasioned by conduction through the now disjoint cylinder walls. In addition, it becomes possible by this arrangement to connect the drive mechanism in the vicinity of the midpoint 80 of each connecting rod 81, the locus of which is now centrally disposed within the machine. This permits the natural separation and convenient collocation of coolers 77 and heaters 78 in positions which are at extreme diametrically opposite ends of the machine. This serves to minimize thermal losses and thereby improve the overall thermal efficiency, while at the same time it permits a substantial simplification in the design and construction of the heat exchange elements as compared to the prior art.

Figure 12:
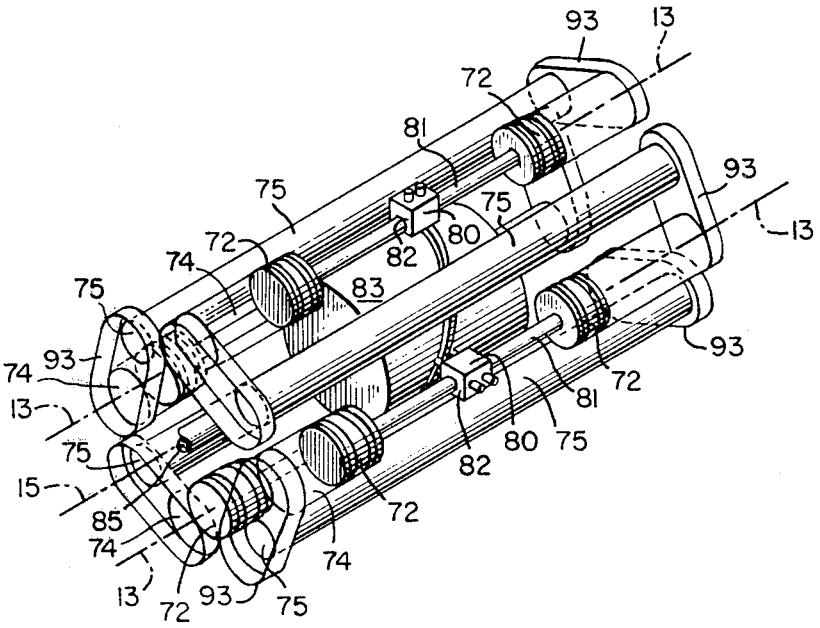
FIG. 12 is a perspective view of the drive assembly and interconnected working volumes of a drum cam machine.

Any number of piston-cylinder pairs can be interconnected in the manner illustrated for four cylinders in FIG. 11, as long as the proper phase shift is maintained between each set. This can be accomplished, as shown in FIG. 12, by taking the drive from sets 82 of paired rotary gudgeon pins located at the mid-point 80 of each double-ended piston connecting rod 81. Each gudgeon pin assembly 82 is a low friction cam follower mechanism which is mated in preloaded intimate contact with the protruding surfaces of cylindrical drum cam 83 and the linear surfaces of longitudinal cams 91. Cylindrical drum cam 83 mechanically converts uniform angular rotation of drive shaft 85, guided by low friction bearings 92 and 92', into simple harmonic reciprocation of each double-ended piston 72 and vice versa. The proper phase relationship is kinematically determined by the relative angular position of each piston-cylinder pair about the machine axis of symmetry 15.

Figure 13:
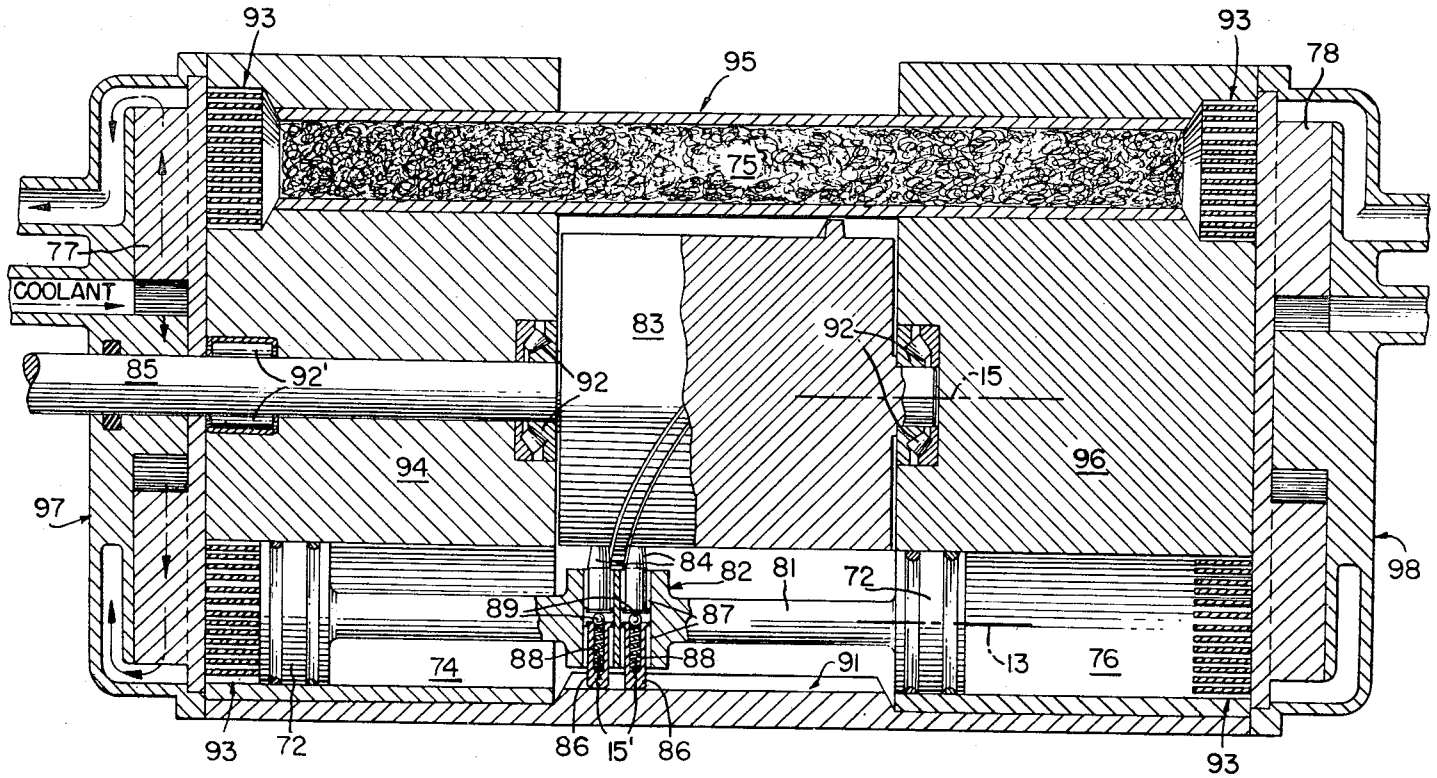
FIG. 13 is an offset sectional view of the drum cam machine of FIG. 12.

As shown in FIG. 13, each gudgeon pin assembly 82 consists of pairs of drum cam followers 84 and matching oppositely directed pairs of longitudinal cam followers 86 supported by means of precision low friction needle or roller bearings 87. Spring 88 serves to maintain the requisite preloading force, while balls 89 decouple the rotation of drum cam followers 84 from the rotation of longitudinal cam followers 86. All longitudinal cam followers 86 are constrained to move back and forth within longitudinal cams 91, which are parallel to both machine axis of symmetry 15 and reciprocation axes 13, and which serve to prevent the relative rotation of pistons 72 within the bore. Follower axes of rotation 15' are oriented radially with respect to the machine axis of symmetry 15.

Figure 14:
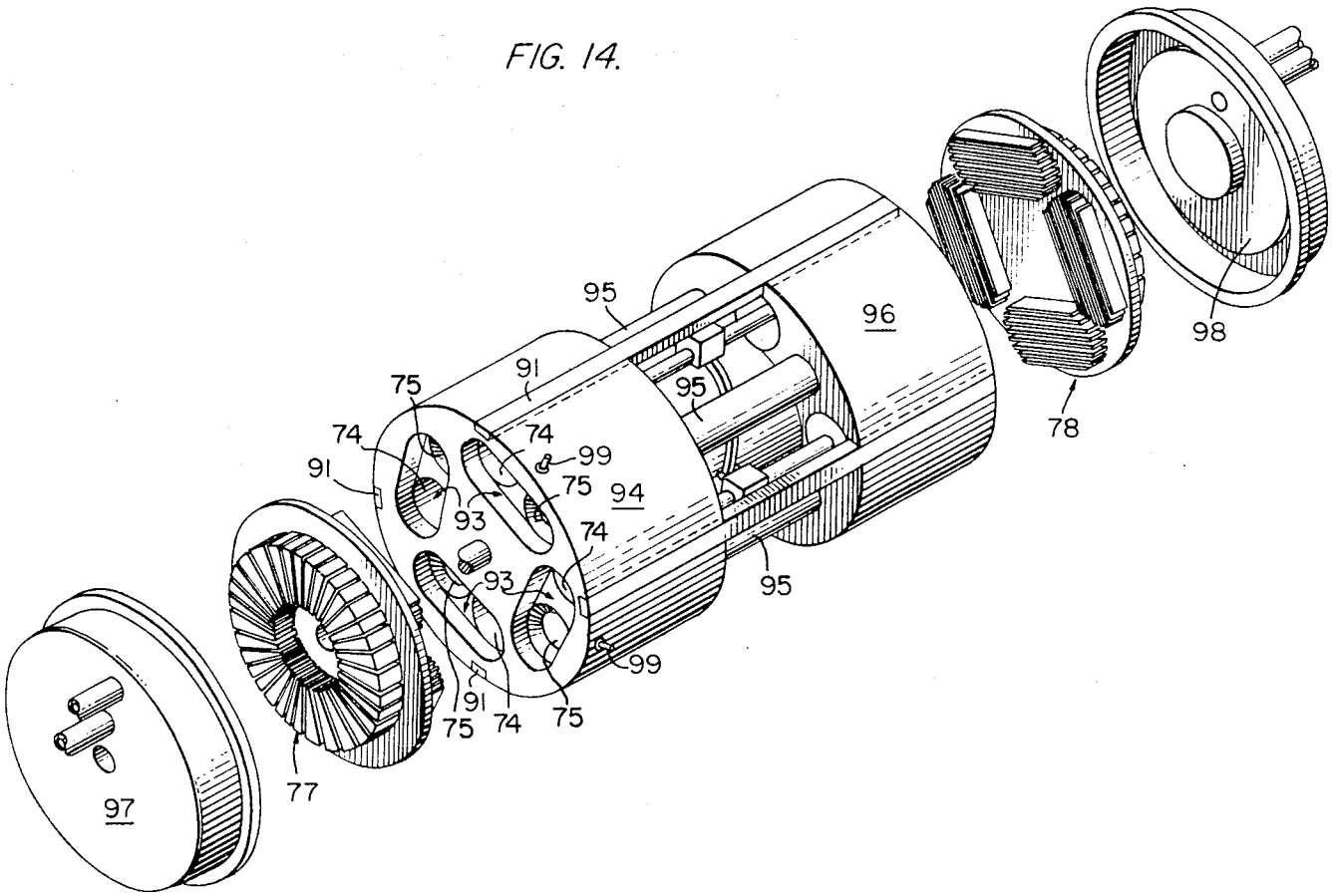
FIG. 14 is a partially exploded perspective view which illustrates the overall functional configuration of the drum cam machine of FIG. 12 and FIG. 13.

Attention is now directed to FIG. 14 wherein the overall functional configuration of the drum cam machine is illustrated. It should be apparent that all compression spaces 74 are collocated within a single stationary right-circular cylindrical "compression block" 94, made of material having comparatively low thermal conductivity. Likewise all expansion spaces 76 are collocated within a single stationary right-circular cylindrical "expansion block" 96, also made of material having comparatively low thermal conductivity. Compression block 94 and expansion block 96 are conjoined by the four regenerator housings 95 and also by the four longitudinal cams 91. At the extreme opposite ends of both compression block 94 and expansion block 96, a series of shallow segmented annular depressions 93 connect each piston-cylinder working volume with an adjacent regenerator duct 75 and serve as a housing for the internal heat transfer surfaces of either cooler 77 or heater 78. Working fluid is conveyed into each piston-cylinder working volume by means of tank valves 99 located on the periphery of compression block 94.

Thus it may be seen that the individual heat exchange elements of each of the aforedescribed separate but interconnected working volumes are naturally and conveniently collocated within a single component, cooler 77 or heater 78. These now consist of a flanged plate made of material possessing comparatively high thermal conductivity, each having a plurality of radial flow passages on the exterior face and a plurality of segmented annular flow passages on the interior face. Cooler 77 serves upon assembly and in conjunction with cooler head 97 to close and connect compression volumes 74 with adjacent regenerators 75 and to transfer heat from the internal working fluid to an exterior sink. Heater 78 serves upon assembly and in conjunction with heater head 98 to close and connect expansion volumes 76 and with adjacent regenerators 75 and to transfer heat from an exterior source to the internal working fluid. It is, therefore, an important teaching of this invention that the drum cam machine so constructed thereby effects the aforesaid interconnection of stages in a uniquely compact annularly folded serpentine head-to-tail arrangement, clearly illustrated by FIG. 12.

The drum cam machine design is an arrangement which involves a minimum number of separate components, and wherein the hot and cold regions of the machine are inherently located at extreme diametrically opposite ends. It should be readily apparent to those skilled in the art that the collocation of cooler elements within a compact cooler head at one end of the drum cam machine, and of heater elements within a similarly compact heater head at the other end of the machine, has the highly desirable effect of reducing heat losses from conduction and radiation to improve the overall thermal efficiency of the machine. But it also leads to a substantial simplification in the design and manufacture of not only the heat transfer elements but also of other mechanical components of the machine as well. For example, both compression block 94 and expansion block 96 may now be very conveniently constructed from identical mass-produced precision investment castings. This could be of crucial importance with respect to economical production in a high volume application, by producing an important savings in the cost of materials and labor. A similar economy of production might also be realized for some applications through the design and fabrication of identical cooler head assemblies 97 and heater head assemblies 98.

Since the closed cycle Stirling prime mover operates solely on the basis of the difference in temperature in the working fluid between the hot expansion space and the cold compression space, the development of useful power output is not specific to the source of heat available for use. Therefore, the design of the heat source can be any one of a large variety of possible types. A rather simple combustion system can be produced, for example, which will cleanly and efficiently burn various kinds of both liquid fuels and gaseous fuels without any modification whatsoever. Thus, it will be appreciated by those familiar with the art that a single prime mover may be made to operate on regular or premium gasoline, diesel oil, alcohol, crude oil, lubricating oil, olive oil, vegetable oil, propane, butane, natural gas, and synthetic coal gas.

It is important at this point to re-emphasize the fact that each small segment of a well-designed regenerator transfers heat to and from the working fluid with minimal temperature differences. Thus all stages in the regenerator are reversible in an actual thermodynamic sense. Therefore, the entire machine cycle is reversible in function; that is, the direction of flow of heat and work can be reversed. The Stirling engine is truly unique in that it is the only practical example of a thermodynamically reversible machine.

It should be thoroughly understood, therefore, that many of the design concepts disclosed herein for Stirling prime movers are also applicable to the design and development of Stirling refrigerators, heat pumps, air conditioners, and the like. It is another important specific teaching of this invention that machines of this kind would be appreciably more efficient than conventional vapor cycle reciprocating refrigerators or thermally-activated absorption refrigerators, with a substantial savings in size and weight. In addition, a hybrid device obtained from the combination of a Stirling prime mover mechanically coupled to a Stirling heat pump will permit both multifuel and nonfuel powered refrigeration units to be developed and applied to specialized applications.

In view of the foregoing it should be readily apparent to those skilled in the art that the operation of the present invention may be accomplished by means of and in the context of an enormous variety of diverse applications. In fact, virtually every market in the world which is currently occupied by the application of a reciprocating internal combustion prime mover, or by the application of a conventional vapor cycle, absorption, or other type of refrigeration device, is subject to improvement by virtue of the deligent application of the teachings of this invention.

These include but are by no means limited to the following: automotive prime movers, marine prime movers, aeronautical prime movers, astronautical prime movers, industrial prime movers, military prime movers, agricultural prime movers, multifuel prime movers, nonfuel prime movers, portable prime movers, biomedical prime movers, refrigerators, air conditioners, cryogenic cooling engines, residential heat pumps, industrial heat pumps, military heat pumps, water coolers, air compressors, other gas compressors, remote electric generators, portable generators, stationary electric generators, hydroelectric power converters, nuclear power converters, radioisotope power converters, solar power converters, geothermal power converters, ocean thermal power converters, biomass power converters, solid waste power converters, small cogeneration power plants, large cogeneration power plants, remote fluid pumps, portable fluid pumps, stationary fluid pumps, remote power tools, portable power tools, outdoor power tools, underwater power tools, toys and novelties.

Obviously, many modifications and variations of the present invention may occur to those skilled in the art in the light of the above teachings. Indeed, every potential application of a Stirling-cycle engine which may be accomplished by machines operating in accordance with the principles set forth herein is, in and of itself, a unique and special variation of this invention. It is therefore to be understood that within the scope of the appended claims the invention may be practiced otherwise than as specifically described.

I claim:

1. A reciprocating, single-acting, multiple-piston, Stirling-cycle thermal machine which includes a frame; at least one pair of stationary, coaxial, in-line, right-circular cyclinders mounted in said frame, said cylinders being thermally isolated from each other, open at their adjacent ends and closed at their remote ends, one of said cylinders enclosing an expansion space of the machine and the other enclosing a compression space of the machine; an external heat source; an external heat sink; regenerators for each cylinder pair; a heater for each expansion space comprising a heat exchanger element closing the remote end of the expansion space and serving to thermally conductively connect said source to the machine working fluid; a cooler for each compression space comprising a heat exchanger element closing the remote end of the compression space and serving to thermally conductively connect said sink to the machine working fluid; a piston arranged to reciprocate within each of said cylinders, locked against rotation relative thereto and sealing the open end thereof, the pistons of each coaxial pair of cylinders being mechanically linked; cam and cam follower means operatively connecting said pistons to a rotary drive mechanism turning about an axis coaxial with the principal machine axis of symmetry, the symmetry plane of said drive mechanism normal to its axis of rotation being coincident with the plane of symmetry of the reciprocating parts of the machine; the machine working fluid being contained in one or more isolated stages comprising an expansion space, a heater, a regenerator, a cooler, and a compression space connected in series by passages permitting oscillating flow between said spaces.

2. A machine according to claim 1 having only two cylinders and pistons in which the frame includes a ducted axle coaxial with the axis of reciprocation carrying the wall structure of one of said cylinders attached to each of its outer ends, held against longitudinal displacement along said axle by a retainer member permitting working fluid to flow around it, the piston in each cylinder having a central bore in its outwardly-facing top through which said axle extends in sliding, gas-tight relation, the adjacent interiors of each piston carrying a harmonic displacement cylindrical face cam, said cam surfaces being oriented normal to the axis of reciprocation and occupying a specified relative angular position about the machine axis of symmetry within plus or minus 90 degrees one with respect to the other, the hollow center of said ducted axle forming the passage connecting the heater and cooler and containing the regenerator.

3. A machine according to claim 2 in which one of the cylinder wall structures is fixed against rotation relative to the frame and the other is held by retainer means which permit such rotation.

4. A machine according to claim 3 including means for effecting rotation of one cylinder structure relative to the other whereby the instantaneous phase angle between the periodic reciprocating motions of the pistons can be adjusted.

5. A machine according to claim 4 connected to a vehicular load wherein the external heat source includes thermal energy storage means and the range of phase angle adjustment includes a negative torque mode.

6. A machine according to claim 1 having at least four pairs of cylinders in which the frame includes an expansion block holding all expansion spaces in an annular array, and a compression block holding all compression spaces in a like annular array, with the axes of reciprocation of each pair of cylinders parallel to and symmetrically disposed about the principal machine axis of symmetry, the pistons in each pair of cylinders being joined by a rigid connecting rod carrying at its midpoint the cam follower means, said cam follower engaging a right-circular cylindrical drum cam holding the input-output shaft, said cam and shaft being guided by journal bearing means in the frame for rotation about an axis coaxial with the machine axis of symmetry, the machine working fluid being contained in a number of stages corresponding to the number of cylinder pairs, with the expansion space of each stage being in one cylinder pair and the compression space of that space being in another cylinder pair.

7. A machine according to claim 6 having four pairs of cylinders in which the regenerators are contained in tubular passages parallel to, annularly arrayed among, and coterminous with the cylinders, each extending into segmented depressions within the expansion and compression blocks, each segmented depression serving to connect one cylinder and one regenerator tube end of a stage and to collocate and accommodate heaters within the expansion block and coolers within the compression block, respectively.

* * * * *